United States Patent [19]

Fletcher

[11] 4,169,722

[45] Oct. 2, 1979

[54] ALUMINOTHERMIC PROCESS

[75] Inventor: George W. Fletcher, Edenvale, South Africa

[73] Assignee: Atomic Energy Board, South Africa

[21] Appl. No.: 825,827

[22] Filed: Aug. 18, 1977

Related U.S. Application Data

[63] Continuation of Ser. No. 689,390, May 24, 1976, abandoned.

[30] Foreign Application Priority Data

May 28, 1975 [ZA] South Africa ..... 75/3447
May 28, 1975 [ZA] South Africa ..... 75/3448

[51] Int. Cl.[2] ..... C22B 4/04; C22B 5/00

[52] U.S. Cl. ..... 75/10 R; 75/27; 75/84

[58] Field of Search ..... 75/10–12, 75/27, 68 R

[56] References Cited

U.S. PATENT DOCUMENTS 3,597,192 8/1971 Wilhelm ..... 75/84

FOREIGN PATENT DOCUMENTS 672420 11/1965 Belgium ..... 75/10 R
1418773 10/1965 France ..... 75/10 R

*Primary Examiner*—P. D. Rosenberg
*Attorney, Agent, or Firm*—Stevens, Davis, Miller & Mosher

[57] ABSTRACT

A method of conducting an aluminothermic reduction of an oxide of a reactive metal comprising melting in a vessel in an induction furnace a conductive susceptor metal and thereafter adding the required intimately mixed reactants to the molten mass in the container wherein the rate of addition of the reactants and the power input to the induction furnace are controlled to maintain the temperature of the molten mass above a predetermined minimum.

11 Claims, 2 Drawing Figures

ALUMINOTHERMIC PROCESS

Figure 1:
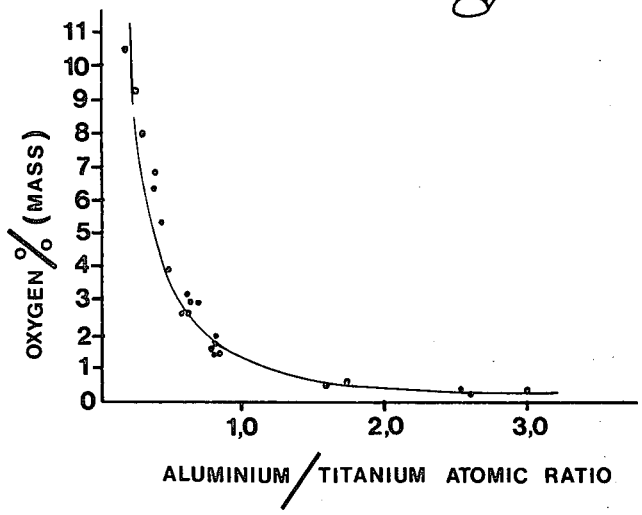

This is a continuation of application Ser. No. 689,390, filed May 24, 1976, now abandoned.

This invention relates to aluminothermic processes wherein aluminium metal is utilized as a reductant for metal oxides ores.

This invention is particularly concerned with the application of the principles of aluminothermic processes to the reduction of oxides of the so called "reactive metals" which comprise tantalum, niobium (columbium), titanium, zirconium, hafnium, molybdenum, chromium and vanadium and the subsequent separation of aluminium and oxygen from such metals and alloys.

The reactive metals are characterised by their extreme avidity for oxygen and the high stability of their oxides. Further, the useful mechanical properties of these metallic elements and their alloys (e.g. ductility) are only obtained when the oxygen and nitrogen contents of such metals and alloys are very low.

Typically the ores of the reactive metals contain oxygen and it is therefore a dominant feature of extractive metallurgical processes for the recovery of these metallic elements and their alloys that processing conditions be contrived such that oxygen is removed from the ore to a very high degree and that reaction with oxygen and nitrogen of the atmosphere be prevented as far as possible.

Conventionally one method of achieving the above objectives is to form the chlorides of the reactive metals thereby achieving the necessary separation of the reactive metal from oxygen. The volatility of the chlorides in many cases also permits of purification by volatilization from many impurities present in the original ore. The purified chloride of the reactive metal may be reduced to the reactive metal by reduction with another metal that is thermodynamically able to remove chlorine from the reactive metal. The product of this metallothermic reduction is the reactive metal (usually in a finely divided state i.e. a sponge) and the chloride of the reductant metal.

This process, named the KROLL process after its inventor Dr. W. J. KROLL, is the dominant extractive metallurgical process presently employed for the preparation of titanium, zirconium and hafnium.

Another method of achieving the desired objectives is by reduction of the oxide ores of the reactive metals by aluminium. This method depends upon the high thermodynamic stability of alumina whereby direct reduction to the reactive metal is achieved. The method of aluminothermic reduction is industrially important at the present time for the production of many metals and alloys (notably ferro-alloys). Such metals and alloys include the reactive metals chromium, niobium, tantalum, molybdenum and vanadium as well as refractory metals such as tungsten.

It is an important feature of many aluminothermic reductions that the high exothermic heat of reaction permits the raising of the slag and metal phases to above their melting points and thus avoids the need for any added heat. Since the melting point of alumina is of the order of 2270 K it is common practice to add calcium oxide to the charge thereby producing a calcium aluminate slag which melts at a lower temperature.

In its usual form the conventional aluminothermic reduction employs a mix containing aluminium powder, the finely divided oxide ore and, optionally, calcium oxide. This mix is contained in a refractory-lined vessel and the exothermic reaction is initiated by heat applied to one portion of the charge for example by burning magnesium or by means of an electric heating element. The reaction then propagates through the charge.

The conventional aluminothermic reduction is essentially a batch process. One finds in practice that recoveries of metal from slag are not uniformly good due to the short time available for reaction and the short time that the slag and metal phases are in the molten state and during which time separation must take place. Much attention must be given to variables such as the particle size of the reactants and their degree of mixing to obtain acceptable recoveries of the valuable metals and alloys.

Where the exothermic heat of reaction is border-line it is possible to add boosters e.g. potassium chlorate with an excess of aluminium powder in order to generate supplementary heat. This method of supplementing the heat of reaction, is, however, limited in practical application by the high costs of the oxidant and the surplus aluminium required.

Where the exothermic heat of reaction of the oxide ore is insufficient by far to raise the temperature of the reactants to give molten slag and metal phases (i.e. although exothermic the reaction is not autothermic), the conventional methods of aluminothermic reduction are clearly not directly applicable. For this reason aluminothermic reduction does not seem to have been applied industrially for the production of titanium, zirconium and hafnium—the metals of Group IVB of the periodic classification of the elements.

Where the heat of reaction is insufficient to render the process auto-thermic or self-supporting, difficulties are experienced in adding the required supplementary heat.

It is an object of this invention to provide a practical method of conducting processes of the above general type wherein heating of the reactants is effected in a convenient and controllable manner.

In accordance with this invention there is provided a method of conducting an aluminothermic reduction of an oxide of a reactive metal comprising melting in a vessel in an induction furnace a conductive susceptor metal and thereafter adding the required intimately mixed reactants to the molten mass in the container wherein the rate of addition of the reactants and the power input to the induction furnace are controlled to maintain the temperature of the molten mass above a predetermined minimum.

Further features of the invention provide for the intimately mixed reactants to be pelletized prior to addition thereof to the molten mass, for the susceptor metal to be a part of a metal product obtained by a previous similar aluminothermic reduction and for the reactants to comprise a finely subdivided oxide ore of a reactive metal, aluminium and optionally a slagging agent.

Still further features of the invention provide for the melting and addition of the reactants to be effected under an inert atmosphere, and for the aluminium in the alloy produced by the process to be evaporated off under vacuum for example in an electron beam furnace.

The vessel used for containing the susceptor metal and in which the reduction is carried out can be an oxide refractory lined vessel (typically a vessel having a rammed lining of alumina grain and a binder) or a cooled type of copper crucible. The vessel will be located in the work coil of an induction furnace which is conveniently a medium frequency induction furnace.

By this means heat may be controllably added and in fact no additional heat need be supplied in some cases where the reaction is autothermic after an initial molten mass of susceptor metal has been obtained.

Preferably the reactants are pelletized and added to the molten mass of metal at a suitable rate by means of a remote controlled feeder device. This enables the process to be carried out in an inert atmosphere where required.

The purity of the reactants employed may be decided with reference to the purity required of the resultant metal. To avoid contamination by atmospheric oxygen and/or nitrogen an atmosphere of inert gas (typically argon) may be created in the reaction volume.

The products of reaction may be poured from the vessel into a mould which when cooled may be removed from the furnace tank. Alternatively, when a water-cooled copper crucible is used, a continuous casting technique may be employed whereby a continuous cast of slag and metal may be caused to emerge from the bottom of the crucible. By either method a clean separation of the metal and slag phases results.

Three major advantages result from this method of aluminothermic reduction as contrasted with the conventional out-of-furnace technique of aluminothermic reduction.

1. The process is not restricted to those reactions that are autothermic.

2. The temperature at which the reaction is conducted may be controlled. In particular the control of temperature permits control of the viscosity of the slag to give improved separation of metal from slag and hence improved yields.

3. The time of the reaction may be controlled. In particular this permits of the provision of adequate time for the separation of the metal from the slag and this leads to improved yields.

We have investigated the aluminothermic reduction of the reactive metals both from theoretical considerations and experimentally.

On the theoretical side we have appreciated that the reactive metal itself is not the only possible metallic product of aluminothermic reduction. In most if not all cases intermetallic compounds of the reactive metal and aluminium can result. The free energy of formation of some of these intermetallic compounds contributes significantly to the overall free energy of the reduction reaction and makes possible a more complete reduction than would be expected from thermodynamic considerations which do not take into account the formation of intermetallic compounds.

Experimentally we have found confirmation for these theoretical ideas.

FIG. 1 shows a plot of the oxygen content of the metal resulting from a series of 24 runs in which, employing the techniques of the invention previously described, commercial rutile was reduced with aluminium powder (of secondary origin) in the presence of lime of commercial quality. The stiochiometry was aimed at producing a product ranging from $TiAl_3$, through the intermediate intermetallic compounds TiAl and $Ti_3Al$ to Ti metal. The relationship between the aluminium-titanium atomic ratio and the oxygen content of the resulting metal shows a break-point at approximately 1,0 atomic ratio. We interpret this as meaning that at atomic ratios above 1,0 (formation of TiAl and $TiAl_3$) the reduction is nearly complete (low oxygen content) whereas at atomic ratios of below 1,0 (formation of $Ti_3Al$ and perhaps some Ti) reduction is not complete.

Figure 2:
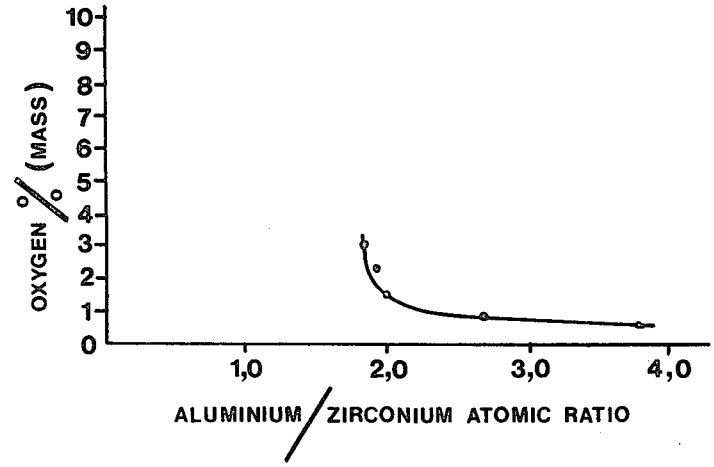

FIG. 2 shows a similar curve obtained for the reduction of zirconium dioxide by aluminium in the presence of lime. In this case the reactants were contained in a recrystallized alumina crucible and were heated in a graphite resistance furnace. Five runs only were made. A similar break-point, at an aluminium/zirconium ratio of 2,0 is shown. This corresponds to the intermetallic compound $ZrAl_2$. We interpret this result to mean that reduction is nearly complete (low oxygen content of metal) when the stoichiometry is such that the intermetallic compounds $ZrAl_2$ and $ZrAl_3$ are made. When compounds with an atomic ratio of less than 2,0 are made—there are seven of these ranging from $Zr_3Al$ to $Zr_2Al_3$—reduction is far from complete.

We believe that curves of the type of FIGS. 1 and 2 will generally characterise the behaviour of the reactive metals during aluminothermic reduction. One skilled in the art will design the composition of the desired aluminium-reactive metal-oxygen alloy in relation to the liquidus temperature, the aluminium content and the oxygen content desired.

We have considered vacuum evaporation as a means of producing the pure reactive metals from the aluminium-reactive metal-oxide alloys made as previously described. We have appreciated that during the course of this evaporation aluminium may be removed to a very large degree by virtue of its greater volatility than that of the reactive metals. Also we have understood that the sub-oxides of aluminium—$Al_2O$ and AlO—have appreciable volatility under high temperatures and low pressures so that they are also volatilized. We believe therefore that given these required conditions and an aluminium-reactive metal-oxygen alloy of suitable composition vacuum evaporation of both aluminium sub-oxides and perhaps some of the reactive metal will proceed simultaneously and to such a degree as will leave a residue of the reactive metal having the desired low content of aluminium and oxygen.

We have further appreciated that upon condensation of the product of evaporation described above the sub-oxides of aluminium will revert to give aluminium metal and alumina. Thus the condensate may be recycled to the aluminothermic reduction step in which the aluminium, recovered directly and via the aluminium sub-oxides, will serve as reductant, the alumina made from the aluminium sub-oxides will report to the slag phase and any evaporated reactive metal will be recycled. By this device oxygen will not build up in the reaction chain and will be discarded in the slag.

Thus the composition of a reactant feed must be chosen to provide the desired results whilst bearing in mind the subsequent removal of the aluminium and the oxygen to yield the reactive metal.

The operation of the invention will now be described by way of experimental results obtained thus far.

EXAMPLE 1

The following series of two tests as applied to the reduction of titanium dioxide was carried out:

In this experiment the total charge consisted of 479.4 g $TiO_2$; 701.48 g Al and 397.38 g of CaO.

In view of the fact that no aluminium-titanium alloy was available for use as a susceptor metal 350.74 g of the aluminium was used as the susceptor metal. This aluminium was in the form of flat discs. The remainer of the aluminium, in the form of powder, the $TiO_2$ and CaO were intimately mixed and pelletized.

The aluminium being used as susceptor metal was introduced into a crucible prepared as described in Example 2. This crucible assembly was supported inside the work coil of a 3 kHz induction furnace, 38 kw by Leybold-Heraeus.

The pelletized feed was loaded into a feeder inside the furnace, the furnace was closed and an argon atmosphere established. The induction furnace was operated and when the aluminium had reached a sufficiently high temperature, the ;ellets were introduced by the feeder device at a rate governed by the temperature of the metal in the crucible; the rate of addition of the pellets was adjusted so that the temperature in the crucible did not drop appreciably when the pellets were added. The entire addition effected at this rate took 44 minutes. As the pellets were dropped into the molten metal, they were heated, whereupon the reaction started and the slag and metallic phases were formed. It was observed that the inductive stirring of the metal was sufficient to ensure adequate heat transfer from the metal to the slag and to the pellets.

The metal and slag were then poured off into a mould and allowed to solidify by cooling. It was found that two metal ingots were formed within the slag which separated cleanly from the ingots.

Of the charge treated the theoretical yield of metal, based on the assumption that the intermetallic compound obtained was $TiAl_3$, is 735.05 g. The actual yield of metal was 650.72 g thus, giving a recovery of 88.5%.

A second run was conducted with a charge of the identical composition to that above described except that all the aluminium was in the form of powder and was intimately mixed with $TiO_2$ and CaO and pelletized. In this case 325.15 g of $TiAl_3$, produced above, was used as susceptor metal. The susceptor metal was all molten after 25 minutes using 265 volts and 32 kw. 1069.76 g of charge was added. The actual yield of metal was 458.13 g as against the theoretical value of 524.06 g. The yield was thus 87.4%.

It was concluded that the process may be effectively used for aluminothermic reductions and is of particular value in cases, such as the aluminothermic reduction of $TiO_2$, where supplementary heat is necessary to sustain the reaction,

EXAMPLE 2

Further and more extensive experiments were conducted with zirconium dioxide ore in the 3 $kH_z$ induction furnace. It was established that satisfactory crucibles having rammed linings could be made as follows.

First, an outer pot of castable cement was made in a mould. Conventional alumina or chromium castable cements that are commercially available were found to be suitable for the outer pot, which was dried in an electrically heated oven at 573 K. The mould—of mild steel sheet—was so designed that it could be stripped after air-drying.

The outer pot was then lined internally with an insulating sheet material. Asbestos or a commercially available heat-resistant slag fibre sheet was was found to be suitable.

For the refractory ramming mix forming an inner lining that would be in contact with the reactants, a number of commercial ramming compounds based on alumina, were tried.

It is now preferred to purchase pure recrystallised alumina grain of particle sizes calculated to give maximum density. As binder, approximately 5 percent of milled slag is incorporated. An advantage of this procedure is that chemical impurities can be controlled. As a cost-reducing feature, which also contributes to better life, it was found that much lining material could be recovered after use, crushed, sized, and re-used.

The dry mix is made into a ramming compound with the minimum amount of water consistent with a workable mix. From this mixture, a base of 35 mm thickness is rammed into place in the outer pot. A mild-steel cylindrical core desired to leave an annular space of 25 mm is then introduced into the crucibles, and the vertical walls are made by ramming of the mixture into this annular space. After being dried in an electrically heated oven at 393 to 413 K for 12 hours, the crucible assembly is placed within the work coil of the induction furnace.

With the furnace tank open to the atmosphere, the furnace is switched on. The crucible is baked slowly at first and then with increased power. The furnace is then closed and an argon atmosphere established by three evacuations, followed by argon flushing. The next step is to increase power to melt the steel core. The melt is maintained for 2 hours in order to sinter the lining. The steel is then poured off into a mould to give a cylindrical core that can be re-used.

In these runs 500 to 600 g of zirconium-aluminium alloy (approximately $ZrAl_3$ in composition) was introduced into a crucible made as described above. The furnace was then closed and an argon atmosphere established. After 5 minutes at 250 V and 31.75 kW, the susceptor metal metal was molten and the voltage was reduced.

A mixture of 737.00 g of zirconium dioxide ore, a variable amount of aluminium powder, and 396.21 g of calcium oxide was made and formed into cylindrical pellets of 12 mm diameter by 12 mm height. These pellets were loaded into the feeder of the furnace and an argon atmosphere was established in the feeder by three evacuations, followed by flushing with argon.

By operation of a feeder device, pellets were dropped into the molten susceptor, the process being observed through the sight glass of the furnace. Each batch of pellets was seen to preheat on contact with the melt, to react rapidly, and to give molten slag and metal as products. By adjustment of the power input and the rate of addition of the pellets, a molten mix comprising two immiscible liquid phases was maintained. The inductive mixing could be seen to be beneficial in turning over the melt so that the pellets were rapidly brought into contact with the molten-metal phase. The entire charge of pellets was added in about 22 minutes in each case.

The furnace power was then switched off, and the crucible contents were poured off into a graphite mould. After the furnace had been cooled and opened, the ingot was removed from the graphite mould, and it was found that the ingot of metal was entirely surrounded by solidified slag. The latter, containing no metal, could easily be chipped away to expose a clean metal ingot containing no inclusions of slag.

The actual charge composition for the series of 18 runs is shown below in Table I:

TABLE 1

| Run number | $ZrO_2$ g | CaO g | Al g | Number of runs |
|---|---|---|---|---|
| S1 to S4 | 737.00 | 396.21 | 835.22 | 4 |
| S5 to S8 | | | 626.42 | 4 |
| S9, S10, S12 | | | 756.62 | 3 |
| S11, S16 | | | 556.82 | 2 |
| S13 to 15 | | | 730.82 | 3 |
| S17 to 18 | | | 696.02 | 2 |

The analytical results of the runs described above are shown in the following two tables wherein Table 2 gives the analysis of the alloys and Table 3 gives the analysis of the slags:

TABLE 2

| | Analytical results for the alloys | | | | | |
|---|---|---|---|---|---|---|
| | RUN NUMBER | | | | | |
| ELEMENT | S1 to S4 % | S5 to S8 % | S9, S10, S12 % | S11, S16 % | S13 to S15 % | S17 to S18 % |
| Zr, % | 42.50 | 47.95 | 40.10 | 52.90 | 43.15 | 47.68 |
| Al, % | 51.43 | 45.66 | 49.26 | 43.45 | 48.04 | 48.05 |
| O, % | 2.03 | 2.32 | 4.51 | 0.63 | 3.45 | 1.15 |
| Si, % | 0.53 | 0.65 | 0.54 | 0.58 | 0.55 | 0.51 |
| TOTAL % | 96.49 | 96.58 | 94.41 | 97.56 | 95.19 | 97.39 |
| Atomic ratio Al to Zr in reactants | 4.09 | 3.22 | 4.15 | 2.78 | 3.76 | 3.41 |

TABLE 3

| | RUN NUMBER | | | | | |
|---|---|---|---|---|---|---|
| COMPOUND | S1 to S4 % | S5 to S8 % | S9, S10, S12 % | S11 S16 % | S13 to S15 % | S17 to S18 % |
| CaO, % | 42.73 | 41.92 | 42.55 | 40.30 | 42.51 | 39.30 |
| MgO, % | 0.25 | 0.22 | 0.30 | 0.48 | 0.42 | 0.41/ |
| $Al_2O_3$, % | 53.17 | 51.39 | 51.94 | 51.69 | 53.45 | 53.02 |
| ZrO, % | 6.41 | 7.98 | 6.60 | 11.14 | 7.44 | 7.60 |
| TOTAL % | 102.56 | 101.51 | 101.39 | 103.61 | 103.82 | 100.33 |

It will be seen from an examination of these results that the zirconium dioxide is effectively reduced and good recoveries are obtained.

Whilst any suitable method of separating the aluminium from the resultant alloy can be used it is considered that evaporation by means of an electron beam furnace is most appropriate.

EXAMPLE 3

The particular furnace employed in the following tests was the model Es 1/3/60 manufactured by Leybold-Heraeus of Germany. This is a relatively small furnace, designed for research and development work. A water-cooled copper crucible of 80 mm diameter was used.

The operational process employed for melting was drip-melting of horizontally fed bars into a continuous casting crucible. By use of a retracting ram operating within the cold-hearth crucible, material drip-melted from the horizontal bar (the electrode) is built up into an ingot. The first material melted fuses onto a starting block fastened to the ram. In the testwork reported, the starting blocks were of zirconium. For second melting, the first-melt ingot becomes the electrode, and another starting block receives the second-melt material. In this way, material can be subjected to a number of consecutive refining melts.

Aluminium-zirconium alloys having an aluminium-zirconium ratio ranging between 2.80 and 3.13 with oxygen content ranging between 0.50 and 1.07% (mass) were melted in an electron beam furnace. The range of beam energies employed was 0.4 to 0.85 kw/cm$^{32}$, the vacuum in the furnace chamber was typically 4 mPa ($3\times10^{-5}$ torr). A variety of cycle times and melt rates was employed.

Table 4 shows the results of three single-melt runs.

From Table 4 it will be seen (Run LH6) that the aluminium content can be reduced from approximately 5% (mass) to 260 ppm. Oxygen is reduced to 1100 ppm. Even at the fastest melt rate (Run LH8) which results in 5% mass of aluminum remaining in the metal, the O content is only 1595 ppm.

Table 5 shows the analytical results obtained in three successive melts. It shows that zirconium with a content of oxygen meeting the requirements of the most rigorous specifications for the metal can be obtained by the procedure described.

TABLE 4

| SINGLE MELT RUNS Melting Results-Runs LH6, 7 and 8 | LH6 | LH7 | LH8 |
|---|---|---|---|
| H. B. Power, kW | 40 | 40 | 40 |
| Beam intensity, kW/cm$^2$ | 0.80 | 0.80 | 0.80 |
| Bar number | Q145 | PA872/3 | Q144 |
| Melted from bar, g | 1 425 | 850 | 1 111 |
| Gain of ingot, g | 592 | 378 | 563 |
| Time of run, h | 2.5 | 1.0 | 0.8 |
| Bar melt rate, g/h | 570 | 850 | 1 916 |
| Yield, % | 41.5 | 44.5 | 50.7 |
| Zirconium recovery, % | 83 | 88 | 96 |
| Al content | 260 p.p.m. | 1.5% | 5.0% |
| Hydrogen, p.p.m. | 8.6 | 3.7 | 12.9 |
| Nitrogen, p.p.m. | 33 | 103 | 247 |
| Oxygen, p.p.m. | 1 100 | 675 | 1 595 |
| Cycle time, s | | | |
| Forward | 4.6 | 4.6 | 4.6 |
| Melting | 60.0 | 60.0 | 60.0 |
| Back | 5.0 | 5.0 | 5.0 |
| Superheat | 145.0 | 70.0 | 45.0 |
| Total | 214.6 | 139.6 | 114.6 |

It will be seen that good purity zirconium was recovered which could be further purified by further remelts if required.

ZIRCONIUM-ALUMINIUM ALLOYS

TABLE 5

| Melting Results-Three Successive Melts Runs LH28, 29 and 30 | | | |
|---|---|---|---|
| Melt | LH28 First | LH29 Second | LH30 Third |
| Aluminium, p.p.m. | 9000 | 120 | <50 |
| Hydrogen, p.p.m. | 6.6 | 4.3 | 4.5 |
| Nitrogen, p.p.m. | 220 | 220 | 95 |
| Oxygen, p.p.m. | 520 | 465 | 238 |

The invention therefore provides an effective process for the aluminothermic reduction of the oxides of the reactive metals. The processes described above could be varied as required and in particular it may be possible to use a cooled copper crucible in the induction furnace to achieve a continuous process.

What I claim as new and desire to secure by Letters Patent is:

1. A method of conducting an aluminothermic reduction of an oxide of a reactive metal selected from the group consisting of titanium and zirconium, comprising melting in a vessel in an induction furnace a conductive aluminum containing susceptor metal, adding said oxide and aluminum to the molten mass in the vessel wherein the rate of addition of the reactants and the power input to the induction furnace are controlled for maintaining the temperature of the molten mass above the melting point thereof, wherein the minimum total amount of aluminum added relative to the reactive metal is the theoretical amount necessary for effecting reduction of the oxide plus an amount equivalent to an atomic ratio of reactive metal to aluminum of 1:1 in the case of titanium and 1:2 in the case of zirconium, and thereafter allowing the reaction mixture to cool and separating the resultant alloy product from the slag.

2. A method as claimed in claim 1 in which the reactants are pelletized prior to addition to the molten susceptor metal.

3. A method as claimed in claim 1 in which the susceptor metal is an alloy obtained by a previous similar aluminothermic reduction.

4. A method as claimed in claim 1 in which the mixed reactants comprise finely subdivided oxide ore of a reactive metal, aluminum powder and a slagging agent.

5. A method as claimed in claim 4 in which calcium oxide is added as a slagging agent.

6. A method as claimed in claim 1 in which the reduction is carried out under an inert atmosphere.

7. A method as claimed in claim 1 in which the reactive metal is recovered from the resultant alloy by evaporating the aluminum under reduced pressure.

8. A method as claimed in claim 7 in which the evaporation is effected in an electron beam furnace.

9. A reactive metal produced by a method as claimed in claim 1.

10. A method as claimed in claim 1 in which the inert atmosphere is argon gas.

11. A reactive metal produced by a method as claimed in claim 5.

* * * * *